United States Patent [19]

Pellaton

[11] 4,135,616

[45] Jan. 23, 1979

[54] METHOD AND APPARATUS FOR STACKING PASTA STRIPS

[75] Inventor: Roy C. Pellaton, Stockton, Calif.

[73] Assignees: Guntert & Pellaton, Inc., Stockton; American Beauty Macaroni Company, Fresno, both of Calif.

[21] Appl. No.: 794,439

[22] Filed: May 6, 1977

[51] Int. Cl.[2] ..... B65G 57/08; B65G 57/18

[52] U.S. Cl. ..... 198/423; 198/380; 271/186; 271/202; 271/216

[58] Field of Search ..... 302/11; 93/93 C; 271/65, 175, 176, 177, 186, 199, 202, 216; 198/380, 401, 402, 406, 418, 423, 460, 462, 493

[56] References Cited

U.S. PATENT DOCUMENTS

| | | | |
|---|---|---|---|
| 2,863,663 | 12/1958 | Richards | 271/216 |
| 3,145,828 | 8/1964 | Hawley | 198/423 |
| 3,363,739 | 1/1968 | Mebus | 198/423 |
| 3,610,401 | 10/1971 | Herendeen et al. | 198/423 |
| 3,870,139 | 3/1975 | Wagner | 198/423 |
| 3,874,740 | 4/1975 | Hurd | 198/380 |

*Primary Examiner*—Robert B. Reeves
*Assistant Examiner*—Jeffrey V. Nase
*Attorney, Agent, or Firm*—Townsend and Townsend

[57] ABSTRACT

In a conveyor line, a pasta stacking apparatus is provided wherein individual spaced strips of pasta such as lasagne are automatically counted and stacked in shingles for loading into a packaging machine. The apparatus comprises an upstream conveyor belt, a downstream conveyor belt disposed slightly below the upstream conveyor belt at a junction, clutch mechanism controlling the motion of the downstream conveyor belt, an air nozzle located below the upstream conveyor belt and disposed to direct the blast of air in a downstream direction across the junction, and a photo-sensor arranged to detect items crossing the junction for operating control apparatus and for tallying the number of items delivered to the junction. In operation, lasagne strips are transported along the upstream conveyor belt to the junction where the presence of each is detected by the photo-sensor as it drops to the downstream belt. A signal responsive to the photo-sensor directs a time delayed blast of air from the nozzle, which lifts the trailng edge of the strip as it passes over the junction, flipping it over the forward edge and onto a stack of lasagne strips in the manner of shingles. During the stacking, forward movement of the downstream conveyor belt is retarded so that the lasagne strips stack in overlapping shingles upon descent to the downsteam conveyor belt. In response to the number of strips tallied by the photo-sensor, the shingled lasagne strips are separated by accelerated advancement of the downstream conveyor belt, thereby yielding a preselected count of lasagne strips in easily retrieved bundles.

7 Claims, 3 Drawing Figures

METHOD AND APPARATUS FOR STACKING PASTA STRIPS

BACKGROUND OF THE INVENTION

This invention relates to pasta packaging and specifically to an apparatus for stacking strips of lasagne in overlapping layers or shingles for rapid packaging in bundles of a preselected size.

In conventional assembly line processing of relatively large sized pasta, such as lasagne, strips of processed pasta are transported at relatively high speeds along a conveyor belt to a packaging station where a worker manually counts and stacks the strips into bundles and loads the bundles into a packaging machine for further processing. In known conveyor belts, it is necessary for the worker to separately pick up each individual pasta strip, stack the strips together manually and load the assembled bundles into the packaging machine. The high conveyor speeds employed in conventional lines generally exceed the ability of the work, and as a result, it is customary to remove large batches of noodles in advance of the worker. Thus conventional lines have the disadvantage of being discontinuous, at least to some extent, and of requiring considerable manual handling of the noodles.

SUMMARY OF THE INVENTION

To overcome the shortcomings of such manual handling, a new station is added in a conveyor line, namely, a pasta stacking apparatus, wherein individual or groups of spaced strips of pasta such as lasagne are automatically counted and stacked in shingles for loading into a packaging machine. The apparatus comprises an upsteam conveyor belt, a downstream conveyor belt disposed slightly below the upstream conveyor belt at a junction, clutch mechanism controlling the motion of the downstream conveyor belt, an air nozzle located below the upstream conveyor belt and disposed to direct the blast of air in a downstream direction across the junction, and a photosensor arranged to detect items crossing the junction for operating control apparatus and for tallying the number of items delivered to the junction. In the preferred embodiment, the apparatus of the present invention is employed in conjunction with an improved relatively low speed conveyor system through which spaced apart lasagne strips are transported along the upstream conveyor belt to the junction where the presence of each is detected by the photosensor as it drops to the downstream belt. A signal responsive to the photosensor directs a time-delayed blast of air from the nozzle, which lifts the trailing edge of the strip as it passes over the junction, flipping it over the forward edge and onto a stack of lasagne strips in the manner of shingles. During the stacking, forward movement of the downstream conveyor belt is retarded so that the lasagne strips stack in overlapping shingles upon descent to the downstream conveyor belt. In response to the number of strips tallied by the photo-sensor, the shingled lasagne strips are separated by accelerated advancement of the downstream conveyor belt, thereby yielding a preselected count of lasagne strips in easily retrieved bundles.

BRIEF DESCRIPTION OF THE DRAWINGS

The invention will be best understood by reference to the following detailed description taken in conjunction with the accompanying drawings in which.

DETAILED DESCRIPTION OF THE PREFERRED EMBODIMENTS

Figure 1:
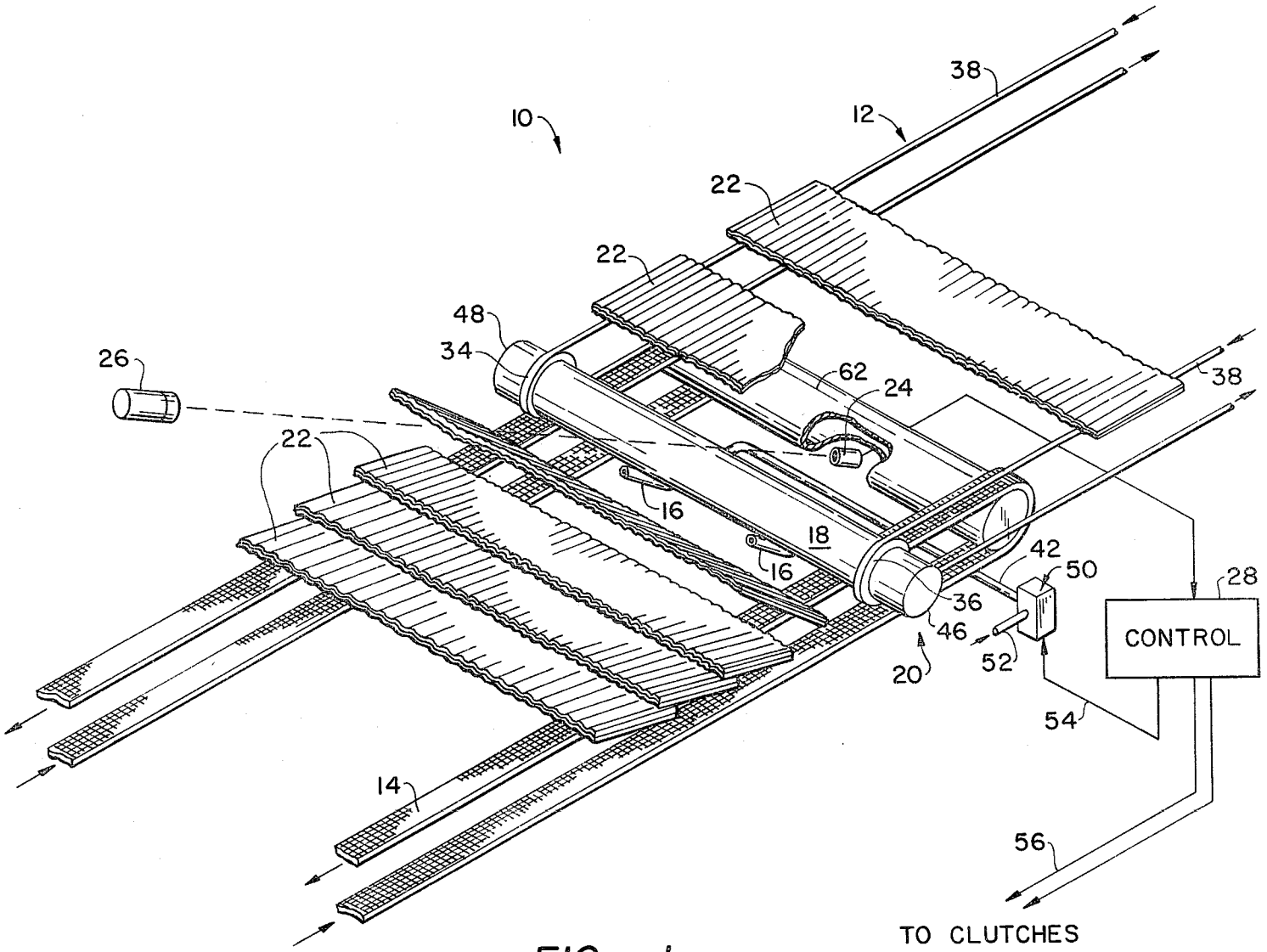
FIG. 1 is a perspective view of the apparatus according to the invention.

FIG. 1 is a perspective view of a conveyor station according to the invention. A pasta stacking or shingling apparatus 10 comprises an upstream conveyor belt 12, a downstream conveyor belt 14 which is disposed in a slightly lower horizontal plane than the upstream conveyor belt 12, at least one and preferably two air nozzles 16 mounted below or within a supporting shaft 18 at the junction 20 between the top surface of upstream conveyor belt 12 and downstream conveyor belt 14. The nozzles 16 are disposed to direct air downstream across the path therebetween and may be adjustable as necessary for maximum effectiveness and balance. Behind the shaft 18 beneath the upstream conveyor belt 12 is a photo-sensor 24, which is aligned with an illumination source 26 located downstream of the junction 20. The photosensor 24 is coupled to controller 28 which in turn is coupled to relays and solenoids controlling a clutching mechanism 32 (FIG. 2) for regulating the translation of the downstream conveyor belt 14 as hereinafter explained.

The shaft 18 is mounted between bearings 34 and 36 supporting drive cords 38 of the upstream belt 12.

The nozzles 16 are coupled to a compressed air feed line 42. A remotely controlled valve 50 regulates the induction of air from an air supply line 52 to the air feed line 42 and thence to the nozzles 16. The valve 50 is regulated by controller 28 via signal line 54.

Figure 2:
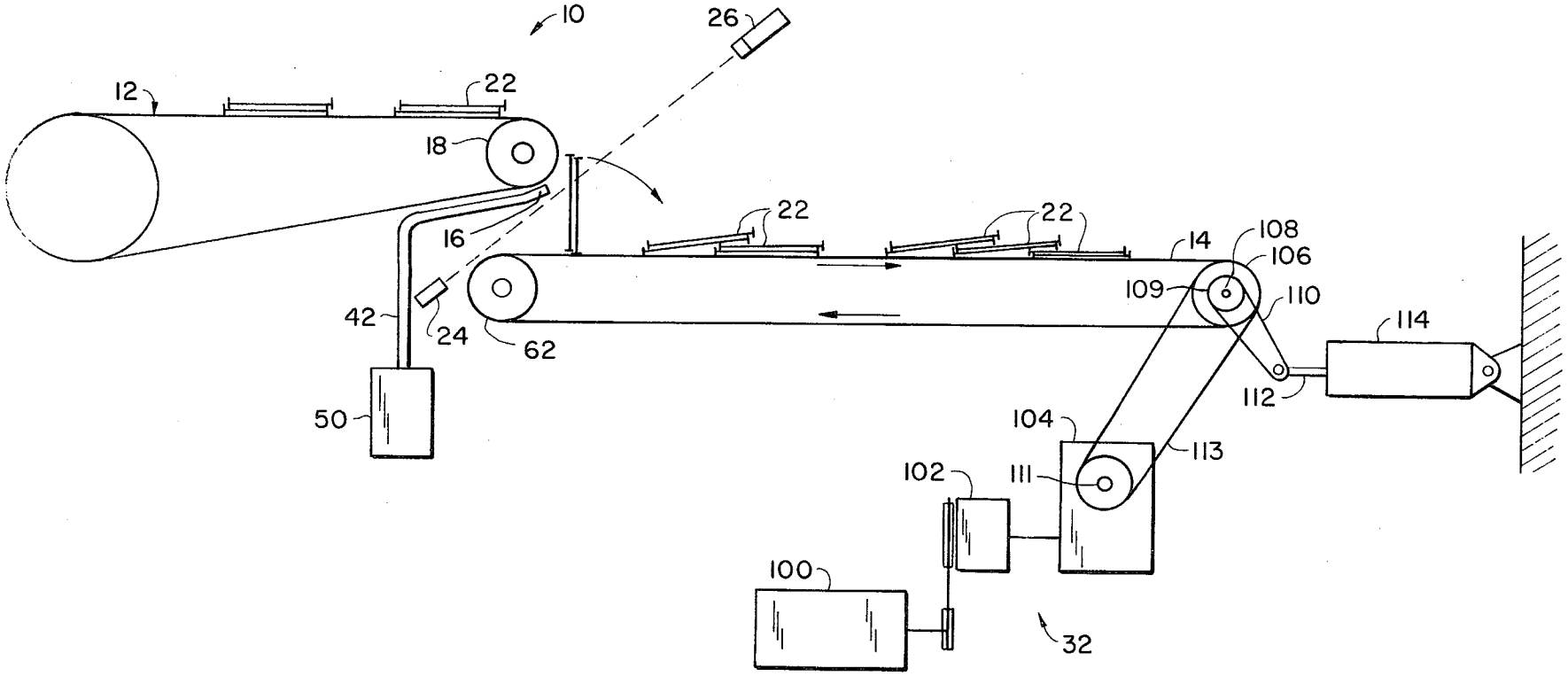
FIG. 2 is a side view of the apparatus.

Referring to FIG. 2, the control mechanism for the downstream conveyor belt 14 is shown in greater detail. The clutching mechanism 32 comprises a vari-drive motor 100 linked to a single revolution clutch 102 which is in turn coupled to a gearbox 104 which is coupled to an overruning clutch 106 on the drive shaft 108 of the downstream conveyor belt 14. A separate overrunning clutch 109 coupled to the first overrunning clutch 106 includes a lever 110 which is linked to a piston 112 of a reciprocating air cylinder 114. The air cylinder 114 is operated by an air valve (not shown) controlled by a solenoid of controller 28 (FIG. 1).

The single revolution clutch 102 controls the incremental advancement of the downstream belt 14. It may be a PSI model CB6 incremental rotation control manufactured by the Warner Electric Break and Clutch Company of Pitman, New Jersey. In the preferred embodiment, clutch 102 includes six dogs arranged at 30°. The gearbox 104 and linkage to the belt 14 provides for uniform or incremental advancement of the belt 14.

The air cylinder 114 through advancement of piston 112 moving arm 110 provides a selected long gap advancement of the belt 14 by overriding gearbox 104 through the first overrunning clutch 106. The second overrunning clutch is necessary for return of unhindered arm 110 and piston 112 while conveyor belt 114 is in movement. The air cylinder 114 is operated under control of the control unit 28, utilizing the sensing device as the input signal. An alternative embodiment might comprise the inclusion of first overrunning clutch 106 in the gearbox 104, for example linking drive shaft 111 to drive belt 113. This arrangement also permits override of gearbox 104 upon advancement of piston 114.

Figure 3:
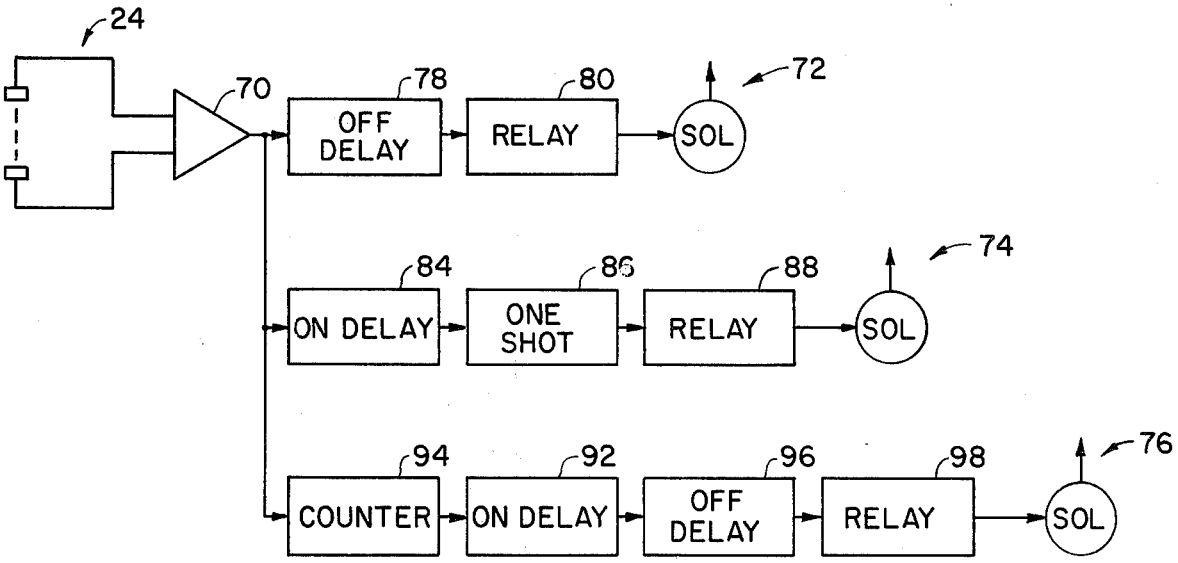
FIG. 3 is a block diagram of the control logic associated with the invention.

Turning to FIG. 3, the control logic of the controller 28 is shown. The controller 28 is coupled to the photosensor 24 through a trigger circuit 70 which provides an on or an off signal depending upon the presence or absence of a light blocking strip at the junction of the upstream conveyor belt 12 and the downstream conveyor belt 14. The controller 28 includes three parallel sub-circuits, mainly, a gap sensor circuit 72, an air blast sensor circuit 74 and a clutch controller circuit 76.

The gap sensor circuit 72 is used to start and stop the lasagne shingle conveyor whenever the gap between successive strips of lasagne exceeds a preselected time-delay as controlled by an internal timer. Whenever the gap exceeds the selected time, internal logic elements send an output signal to a relay 80 which in turn energizes a solenoid of the single revolution clutch 102 to disengage the drive of the downstream belt 14. The shingled pasta on conveyor belt 14 is thereby stopped to wait for the next pasta from the upstream conveyor 12. Thus the number of stacks in a counted group is preserved.

The air blast circuit 74 includes a second delay element 84 coupled in series with a one-shot circuit 86, which is coupled to a second relay 88 for controlling air valve 50. The air blast circuit 74 is operative to send a very short time blast of air directed at the trailing edge of each stack of pasta strips as the stack falls from the upstream belt 12 to the downstream belt 14. Delay element 84 provides an on delay upon receipt of a signal from the photo-sensor indicating that the pasta stack is covering the light. The length of the delay is selected so that the air blast is not initiated until the pasta has encountered and settled on the downstream conveyor 14. The one-shot 86 is then activated to provide an air blast of timed length to assure that the pasta stack falls forward. It is found that the adjustment of the timing of elements 84 and 86 is critical to proper high speed operation of the conveyor system.

The clutch controller circuit 76 includes a counter 94 coupled in series with a third delay element 92 and a fourth delay element 96, which in turn is coupled to a relay 98 controlling the air valves of air cylinder 114.

The counter 94 receives a signal from the photosensor 24 to tally the lasagne stacks as they pass the beam. The counter may be preset to any desired bundle count. When the preset number has been reached by the counter 94, an output signal is delivered to delay element 92 which activates a time-delay corresponding to the delay of second delay element 84. The third delay element activates fourth delay element 96 which provides a timed activating signal to the advance cylinder 114 to operate the overrunning clutch 106 thereby to draw a gap between bundles on downstream belt 14.

The invention has been described with reference to specific embodiments. Other embodiments will be apparent to those of ordinary skill in the art in light of the present disclosure. Therefore, it is not intended that the invention be limited except as indicated by the appended claims.

I claim:

1. A method for stacking pasta strips for subsequent packaging comprising: conveying substantially dry pasta strips as a stack of at least one strip in a sequential manner along a first conveyor belt; discharging each said stack sequentially from said first belt to a second relatively lower conveyor belt in a manner tending to flip said stack trailing side forward; directing a stream of air substantially only at the moment said leading side of said stack encounters said second belt and in a downstream direction from between said first and second belts across the path of said stack to assist to flip said stack forward; retarding the translation of said second conveyor belt relative to the first conveyor belt to permit the sequential overlapping of stacks; and separating a preselected count of stacks on said second belt as a bundle.

2. A method according to claim 1 wherein said retarding step comprises cyclically halting said second belt for a preselected time interval after translation by a preselected distance, said time interval and said translation distance being respectively selected to conform with the speed of said first belt and the height of said stack to permit forward sequential overlaying of said stacks.

3. A method according to claim 2, wherein said bundle separating step comprises counting said stacks passing to said second belt and providing a signal indicative of the accumulation of a preselected count per bundle, and, in response to said signal, rapidly indexing said second belt to deplace said bundle.

4. An apparatus for stacking pasta strips in selected bundles in a conveyor line comprising:

a first constantly moving conveyor belt means adapted to convey sequentially aligned stacks of at least one pasta strip each;

a second conveyor belt means disposed immediately downstream of and lower than said first belt means;

said first belt means including means for discharging said stack from said first belt means to said second belt means in a manner tending to flip a trailing edge of said stack forward, said discharging means comprising a shaft supporting the downstream end of said first belt means immediately above a path of said second belt means;

means for directing a stream of air at selected intervals in a downstream direction from between said first and second belt means across the path of said stack and at said trailing edge for urging said trailing edge to flip forward;

a sensing means and a control means for counting said stacks and adapted to regulate said stream of air to impinge substantially only on said trailing edge;

first means coupled to said control means for indexing said second second belt means a first preselected distance for establishing sequentially overlapping stacks of strips as the stacks are flipped forward, said first indexing means comprising an incremental rotation clutch means coupled to said second belt means and motor means coupled to said incremental clutch means;

second means coupled to said control means and adapted for indexing said second belt means a second preselected distance for establishing bundles of stacks, said second indexing means comprising first overriding clutch for overriding said motor means and a second overriding clutch for overriding said belt means; and wherein the path of said second belt means is substantially devoid of means for constraining movement of said bundles on said second belt means.

5. For use in a conveyor line, an apparatus for stacking pasta strips for subsequent packaging comprising:

a first constantly moving conveyor belt means adapted to convey stacks of at least one substantially dry pasta strip aligned sequentially;

a second conveyor belt means disposed immediately downstream of and lower than said first belt means;

said first belt means including means for discharging said stack from said first belt means to said second belt means in a manner tending to flip a trailing edge of said stack forward, said discharging means comprising a shaft supporting the downstream end of said first belt means and which is substantially devoid of any supplemental contraining means adjacent said downstream end;

means for directing a stream of air in a downstream direction from between said first and second belt means upwardly across the path of said stack and at said trailing edge of said stack at sensed intervals corresponding to the moment of inpingement of said at least one pasta strip on said second belt means for assisting said stack to flip forward and to overlap at least one previous stack on said second belt means;

means for intermittently indexing said second belt means a preselected distance for establishing bundles of said stacks; and wherein the path of said second belt means adjacent said first belt means is devoid of means for constraining said bundles.

6. An apparatus according to claim 5 further including a sensing means and a control means for counting said stacks, for regulating said stream of air and for controlling said indexing means to establish a bundle having a preselected count of stacks.

7. An apparatus according to claim 6 wherein said sensing means comprises a photo-sensor disposed at an angle generally parallel to said air stream directing means to view the vertical path of said stacks between said first belt means and said second belt means.

* * * * *